US009379491B2

(12) United States Patent
Lee

(10) Patent No.: US 9,379,491 B2
(45) Date of Patent: Jun. 28, 2016

(54) ELECTRICAL CONNECTING DEVICE

(71) Applicant: Samsung Electronics Co., Ltd., Gyeonggi-do (KR)

(72) Inventor: Hai-Min Lee, Gyeonggi-do (KR)

(73) Assignee: Samsung Electronics Co. Ltd. (KR)

( * ) Notice: Subject to any disclaimer, the term of this patent is extended or adjusted under 35 U.S.C. 154(b) by 0 days.

(21) Appl. No.: 14/618,575

(22) Filed: Feb. 10, 2015

(65) Prior Publication Data

US 2015/0229076 A1 Aug. 13, 2015

(30) Foreign Application Priority Data

Feb. 10, 2014 (KR) ..... 10-2014-0015092

(51) Int. Cl.

| | |
|---|---|
| ***H01R 4/64*** | (2006.01) |
| ***H01R 13/658*** | (2011.01) |
| ***H01R 13/24*** | (2006.01) |
| *H01R 12/71* | (2011.01) |
| *H01R 13/6594* | (2011.01) |
| *H01R 13/6596* | (2011.01) |

(52) U.S. Cl.

CPC ..... *H01R 13/658* (2013.01); *H01R 12/714* (2013.01); *H01R 13/2407* (2013.01); *H01R 12/716* (2013.01); *H01R 13/6594* (2013.01); *H01R 13/6596* (2013.01); *H01R 2201/02* (2013.01)

(58) Field of Classification Search

CPC .. H01R 4/64; H01R 13/65802; H05K 9/0039; H05K 9/0032

See application file for complete search history.

(56) References Cited

U.S. PATENT DOCUMENTS

| | | | | | |
|---|---|---|---|---|---|
| 4,640,979 | A * | 2/1987 | Schmalzl | H05K 9/0016 | 174/366 |
| 4,823,235 | A * | 4/1989 | Suzuki | H05K 9/0039 | 174/354 |
| 5,833,480 | A * | 11/1998 | Austin | H01R 4/64 | 24/295 |
| 5,934,915 | A * | 8/1999 | Henningsson | H05K 9/0016 | 174/354 |
| 5,984,697 | A * | 11/1999 | Moran | H01R 13/24 | 361/804 |
| 6,019,614 | A * | 2/2000 | Baur | H05K 9/0039 | 439/883 |
| 6,149,443 | A * | 11/2000 | Moran | H01R 13/2435 | 439/66 |
| 6,149,444 | A * | 11/2000 | Shi | H01R 13/65802 | 439/939 |
| 6,201,710 | B1 * | 3/2001 | Bagung | H05K 9/0039 | 174/51 |
| 6,821,133 | B1 * | 11/2004 | Latal | H01R 13/745 | 439/92 |
| 6,863,547 | B2 * | 3/2005 | Park | H01R 13/65802 | 439/66 |
| 7,247,053 | B2 * | 7/2007 | Yamagata | H01R 12/58 | 439/607.53 |
| 2002/0013095 | A1 | 1/2002 | Katoh et al. | | |
| 2002/0142632 | A1 * | 10/2002 | Moore | H01R 4/64 | 439/95 |
| 2008/0113532 | A1 * | 5/2008 | Smeltz | H01R 13/40 | 439/92 |

* cited by examiner

*Primary Examiner* — Gary Paumen
(74) *Attorney, Agent, or Firm* — The Farell Law Firm, P.C.

(57) ABSTRACT

An electrical connecting device is provided, which includes a plate part fixed a first structure, and a leg extending from the plate part. When the first structure is mounted on a second structure, the leg is electrically connected to a housing part provided in the second structure.

14 Claims, 10 Drawing Sheets

ELECTRICAL CONNECTING DEVICE

PRIORITY

This application claims priority under 35 U.S.C. §119(a) to Korean Patent Application Serial No. 10-2014-0015092, which was filed in the Korean Intellectual Property Office on Feb. 10, 2014, the content of which is incorporated herein by reference.

BACKGROUND OF THE INVENTION

1. Field of the Invention

The present invention relates generally to an electronic device and, more particularly, to an electrical connecting device applied to the electronic device.

2. Description of the Related Art

An electronic device may include at least two electronic accessories electrically connected with one another. For example, a substrate can mount a plurality of electronic function groups, or this substrate can be also electrically connected with another substrate.

Electronic devices having various functions, as well as being advantageous to carriage, can be more competitive than other electronic devices. For example, although having the same functions, portable electronic devices that are slimmer, lighter, and smaller are preferred. Accordingly, portable electronic device manufacturers are racing to develop portable electronic devices that are slimmer, lighter, and smaller, while having superior functionalities compared to other products.

The accessories of the electronic device can be also spaced apart at regular intervals and arranged within the electronic device. This spaced arrangement can be caused by a design structure between the accessories within the electronic device, or can be an intentional design for preventing noise generated from each of the accessories from deteriorating the performance of a counterpart belonging within the electronic device. For example, to shield noise or electromagnetic waves radiated from the electronic function groups mounted on the substrate, shield can be mounted on the electronic function groups.

Further, to effectively ground the discharge of static electricity generated outside, an electrical connection between the substrate and metal accessories of the electronic device can be also attempted.

Additionally, an electrical connection between a substrate and metal accessories of the electronic device is also attempted for to extend a grounding area of the substrate.

For the sake of electrical connection between at least two accessories, a separate electrical connecting device may be accompanied. This electrical connecting device should include an electrical connecting structure with excellent durability, providing a long use of an electronic device and resistance to external impact.

Current electrical connections between a substrate and a bracket are attempted using conductive shield foam, a gasket, a C-clip, etc. However, using this type of single contact structure, if the single contact portion is separated or an adhesive force of the shield foam deteriorates over time or from an external impact, the performance of an electronic device deteriorates because it cannot properly perform all of its functions.

SUMMARY OF THE INVENTION

Accordingly, the present invention has been made to address at least the problems and/or disadvantages described above and to provide at least the advantages described below.

An aspect of the present invention is to provide an electrical connecting device with improved structural reliability over long-time use.

Another aspect of the present invention is to provide an electrical connecting device that provides improved continuous electrical connection, even after external impact.

Another aspect of the present invention is to provide an electrical connecting device with simple and convenient assembly.

Another aspect of the present invention is to provide an electrical connecting device that prohibits mutual interference between peripheral accessories.

In accordance with an aspect of the present invention, an electrical connecting device is provided, which includes a plate part fixed a first structure, and a leg extending from the plate part. When the first structure is mounted on a second structure, the leg is electrically connected to a housing part provided in the second structure.

In accordance with another aspect of the present invention, an electronic device is provided, which includes a substrate; an electrical connecting device mounted on the substrate; and a metal bracket electrically connected to the substrate via the electrical connection device. The electrical connecting device includes a plate part fixed to a first structure; and a leg extending from the plate part. When the first structure is mounted on a second structure, the leg is electrically connected to a housing part provided in the second structure.

BRIEF DESCRIPTION OF THE DRAWINGS

The above and other aspects, features and advantages of certain embodiments of the present invention will be more apparent from the following detailed description when taken in conjunction with the accompanying drawings, in which.

DETAILED DESCRIPTION OF EMBODIMENTS OF THE INVENTION

Figure 1:
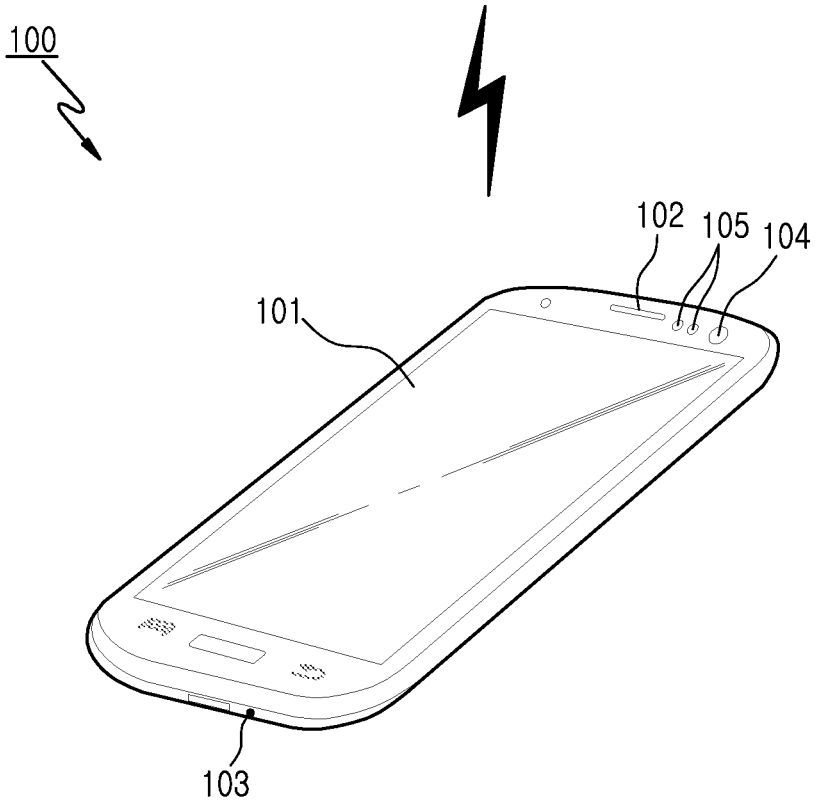
FIG. 1 illustrates an electronic device according to an embodiment of the present invention.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

In describing various embodiments of the present invention, at least two spaced electronic accessories are arranged within an electronic device. Further, the various embodiments of the present invention may be applied to various electronic devices in which respective accessories are electrically connectable with one another. For example, an electronic device herein may include a Personal Digital Assistant (PDA), a laptop computer, a mobile phone, a smart phone, a netbook, a Mobile Internet Device (MID), an Ultra Mobile Personal Computer (UMPC), a tablet PC, a navigator, MPEG Audio Layer 3 (MP3), various home appliances, etc.

In accordance with an embodiment of the present invention, an electrical connecting device may include a plate part fixed to an exposed contact pad of a first structure, and at least one leg of a constant length formed at the plate part. When the first structure is mounted on a second structure, the leg is electrically connected so that at least a portion of the leg is coupled to a housing part provided in the second structure.

In accordance with an embodiment of the present invention, the first structure and the second structure may be applied in various forms of requiring electrical connection and being spaced apart and arranged. For example, the first structure and the second structure may be at least one of a substrate, a case frame, an antenna device, a bracket, and various kinds of electronic function groups.

In accordance with an embodiment of the present invention, if the first structure is a substrate including a contact pad electrically connecting with a grounding region, the second structure may be a bracket of metal materials. Further, if the first structure is an antenna device having a grounding pad as a contact pad, the second structure may be a bracket of metal materials for attempting grounding region extension or a substrate including a grounding region.

In accordance with an embodiment of the present invention, the contact pad may be formed at the first structure in a patterning manner. Alternatively, the contact pad may be also formed with a metal thin plate is attached to the first structure. The first structure may be also formed in such a manner that the first structure is coated with conductive coating materials. The contact pad may be electrically connected to at least one of a grounding region of the first structure, an electronic function group, and a separate other electronic function group.

FIG. 1 illustrates an electronic device according to an embodiment of the present invention.

Referring to FIG. 1, the electronic device 100 includes a display 101, for example, installed in front thereof, a speaker device 102 installed at an upper side of the display 101, and a microphone device 103 installed at a lower side of the display 101, allowing the electronic device 100 to perform a basic communication functions. For example, the display 101 may be a touch screen device capable of performing input and output in the same region.

Components for performing various functions of the electronic device 100 may be arranged around the speaker device 102. For example, the components include a camera device 104, and a plurality of sensor modules 105, e.g., an illumination sensor for detecting surrounding illumination and/or a proximity sensor.

At least one substrate may be installed within the electronic device 100, and the substrate is electrically connected to a metal bracket being a structure of the electronic device 100, thereby extending a grounding region, while avoiding mutual interference caused by noise between peripheral accessories and attempting performance improvement, and grounding static electricity generated outside the electronic device 100.

According to an embodiment of the present invention, an electrical connecting device is applied between the substrate and the bracket. For example, the electrical connecting device may be firmly fixed to the bracket, and constructed to form multiple contact points with the bracket. Thus, an electrical connection between the substrate and the bracket will not be interrupted even after long use or an external impact that disrupts one of the contact points.

Figure 2:
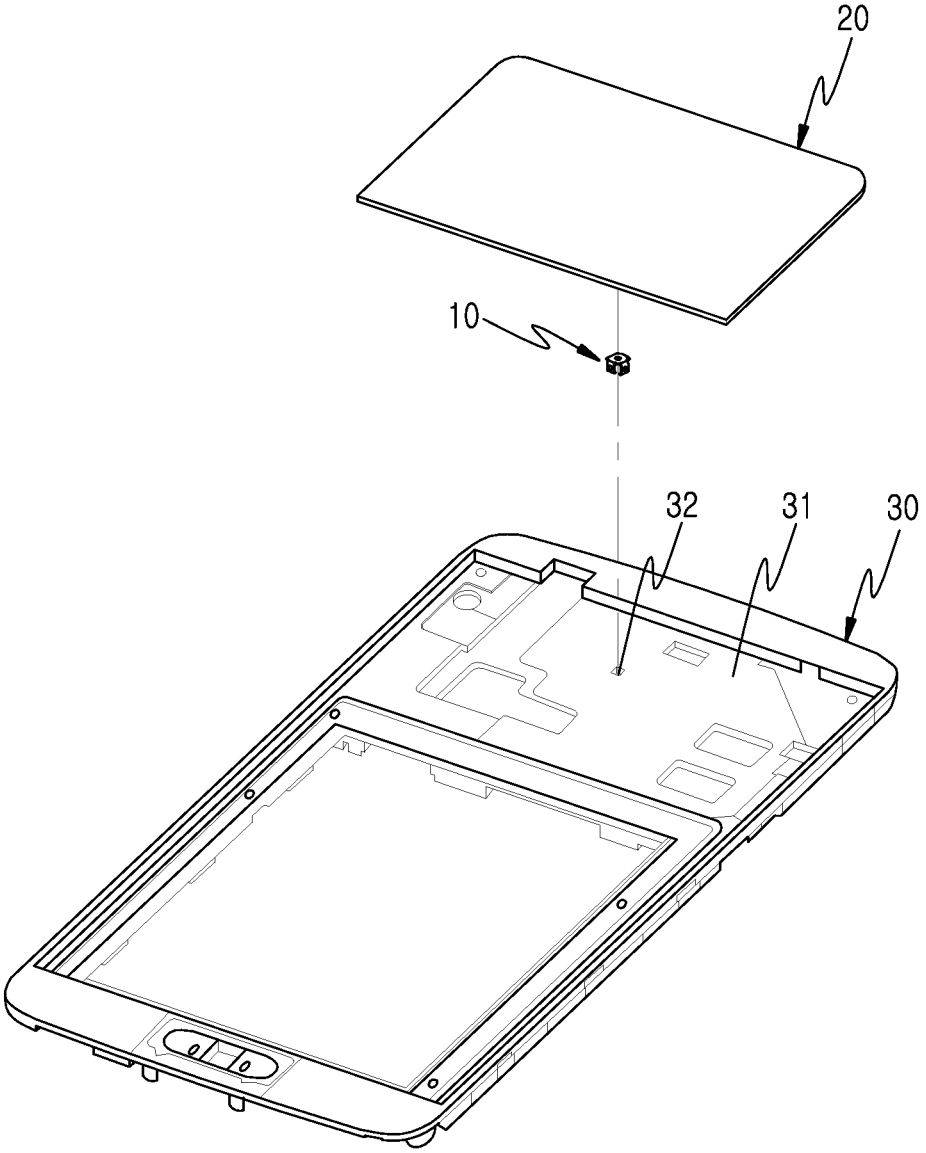
FIG. 2 illustrates an electrical connecting device applied between a substrate and a metal structure according to an embodiment of the present invention.

FIG. 2 illustrates an electrical connecting device applied between a substrate and a metal structure according to an embodiment of the present invention.

Referring to FIG. 2, a metal bracket 30 for reinforcing the electronic device is installed within the electronic device. For example, the bracket 30 may be formed in a die-casting method, in a pressing method, etc. Further, the bracket 30 may be formed of at least one of a magnesium alloy, an aluminum alloy, and a Steel Use Stainless (SUS).

A substrate 20 of the electronic device is arranged in proximity to the bracket 30. To extend a grounding area of the substrate 20, an electrical connecting device 10 is arranged between the substrate 20 and the bracket 30. Herein, the substrate 20 may be referred to as a first structure, and the bracket 30 may be referred to as a second structure.

The bracket 30 includes a substrate mounting part 31 on which the substrate 20 is mounted. The substrate mounting part 31 includes a housing recess 32 for receiving a part of the electrical connecting device 10 in a corresponding position. Although one electrical connecting device 10 is arranged in FIG. 2, the present disclosure is not limited to one electrical connecting device 10. For example, two or more electrical connecting devices may be arranged, and the substrate mounting surface 31 of the bracket 30 may include additional housing recesses for receiving the respective electrical connecting devices in corresponding positions.

The electrical connecting device 10 may be mounted on a corresponding grounding pad of the substrate 20, and may also maintain an electrical connection and provisional assembly state through inserting a part of the electrical connecting device 10 into the housing recess 32 by only an operation of mounting the substrate 20 on the substrate mounting part 31 of the bracket 30.

The electrical connecting device 10 between the substrate 20 and the bracket 30 may also be used for electrical connection between various accessories, such as the substrate 20 and a shield, an antenna radiator and the substrate 20, etc.

Figure 3:
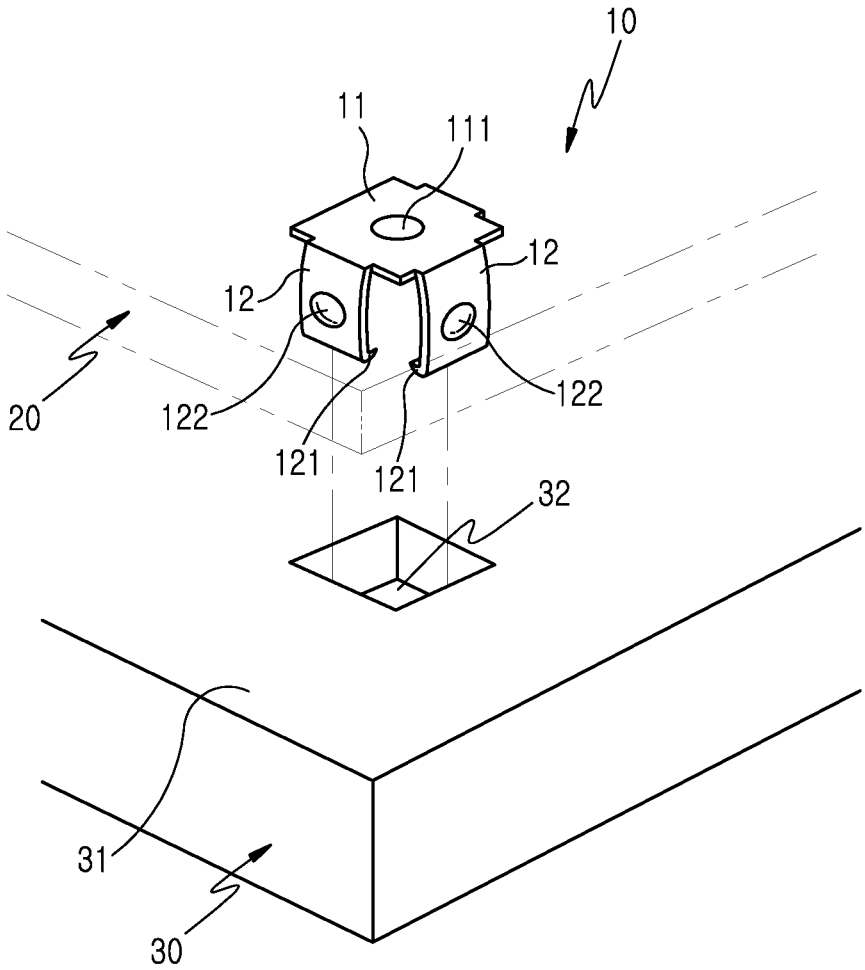
FIG. 3 illustrates an electrical connecting device being applied between a substrate and a metal structure according to an embodiment of the present invention.

FIG. 3 illustrates an electrical connecting device being applied between a substrate and a metal structure according to an embodiment of the present invention.

Referring to FIG. 3, the electrical connecting device 10 includes a plate part 11 and at least two legs 12 that extend from the plate part 11 and bend down.

Although the legs 12 are bent in a predetermined direction in FIG. 3, the present disclosure is not limited thereto. For example, the legs 12 may be also coupled to a housing part through a slanted or protruded portion, in place of a bent portion.

The legs 12 have a shape being curved outside, and come in tension contact to an inner side wall of a housing recess 32 provided in the substrate mounting part 31 of the bracket 30. As illustrated in FIG. 3, there are three legs 12 at regular intervals, but the legs 12 may include four, five, etc., legs.

In FIG. 3, the plate part 11 has a rectangular shape by way of example, and may have another shape such as a polygon, a circle, an oval, etc. The plate part 11 may be formed to have a roughly flat shape to get in surface contact with a grounding pad (e.g., like grounding pad 21 illustrated FIG. 4) electrically connecting with a grounding part of the substrate 20. A pick-up area 111 is formed in the plate part 11, e.g., to be advantageous to a Surface Mount Technology (SMT) of a robotic automation process of the electrical connecting device 10.

Each of the legs 12 has a curved shape and is bent inside at its end, such that the legs 12 may advantageously contact with the inner side wall of the housing recess 32. The ends 121 of the legs 12 are have a hook shape being bent inside, such that when the electrical connecting device 10 is mounted in the housing recess 32 of the bracket 30, each of the legs 12 of the electrical connecting device 10 may be easily placed into the housing recess 32 of the bracket 30. The legs 12 also include a tension protrusion 122 that is embossing-processed outside, such that when the legs 12 are inserted into the housing recess 32 of the bracket 30, the tension protrusion 122 of the leg 12 may also advantageously lead contact with the inner side wall of the housing recess 32. Alternatively, when the legs 12 are injected or pressing-processed, the tension protrusion 122 may be also formed together with the legs 12.

Although FIG. 3 illustrates one electrical connecting device being mounted in one housing recess, the present invention is not limited thereto. For example, a plurality of electrical connecting devices fixed to a substrate at specific intervals may be safely mounted in a plurality of corresponding housing recesses provided in corresponding positions of the bracket. Further, a single housing recess may be provided for housing the plurality of electrical connecting devices, e.g., in a form of a single slit having a constant length capable of housing all of the plurality of electrical connecting devices.

Figure 4:
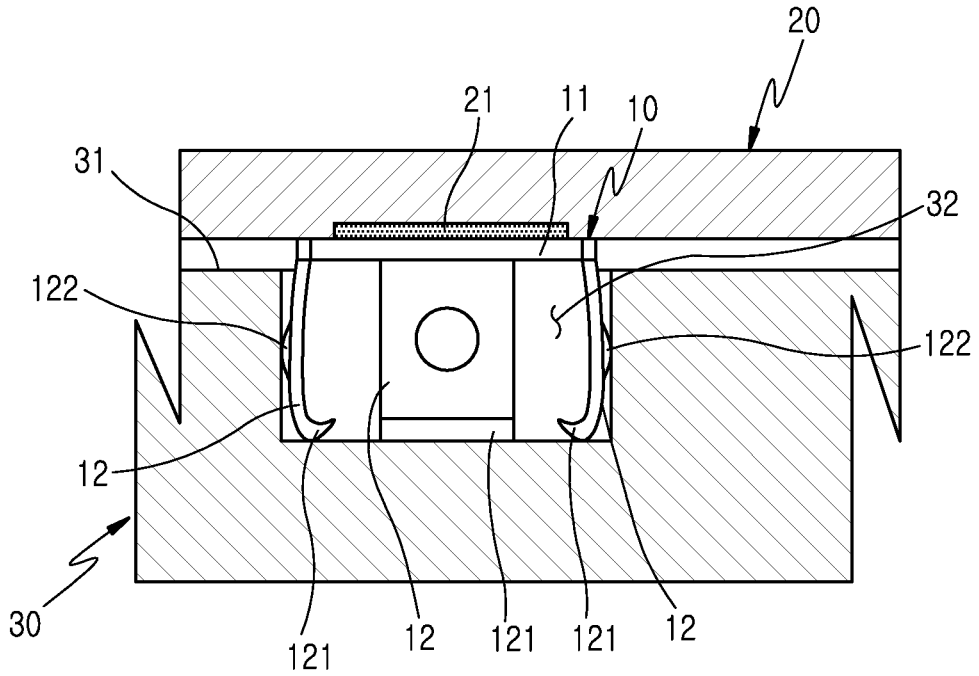
FIG. 4 illustrates an electrical connecting device being installed between a substrate and a metal structure according to an embodiment of the present invention.

FIG. 4 illustrates an electrical connecting device being installed between a substrate and a metal structure according to an embodiment of the present invention.

Referring to FIG. 4, the electrical connecting device 10 is fixed to the substrate 20. The plate part 11 of the electrical connecting device 10 is exposed to the substrate 20, and is fixed to the grounding pad 21 electrically connected with a grounding region of the substrate 20. The plate part 11 may be fixed in a manner of surface contacting with the grounding pad 21 of the substrate 20. For example, the plate part 11 may be fixed to the grounding pad 21 through bonding, soldering, or using a conductive double-sided tape. Accordingly, each of the legs 12 of the electrical connecting device 10 fixed to the substrate 20 protrudes toward the bracket 30.

An electrical connection may be achieved by tightly inserting each of the legs 12 into the housing recess 32 of the bracket 30, by mounting the substrate 20 to which the electrical connecting device 10 is fixed onto the bracket 30.

When the legs 12 are inserted into the housing recess 32, the curve-shaped legs 12 may be compressed, such that the legs 12 provide an exterior force that holds the electrical connecting device 10 in the housing recess 32. As such, when the legs 12 are inserted into the housing recess 32, the legs 12 may not easily be released from the housing recess 32, without a constant force applied.

The tension protrusions 122 of the legs 12 contact an inner side surface of the housing recess 32. Although not illustrated, the inner side surface of the housing recess 32 may further include a tension recess for receiving the tension protrusions 122 of the legs 12.

As illustrated in FIG. 4, the plurality of legs 12 of the electrical connecting device contact inner side walls of the housing recess 32 of the metal bracket 30 and form multiple contact points with the housing recess 32. As such, these multiple contact points have a greater joint force than that of a single contact.

Figure 5:
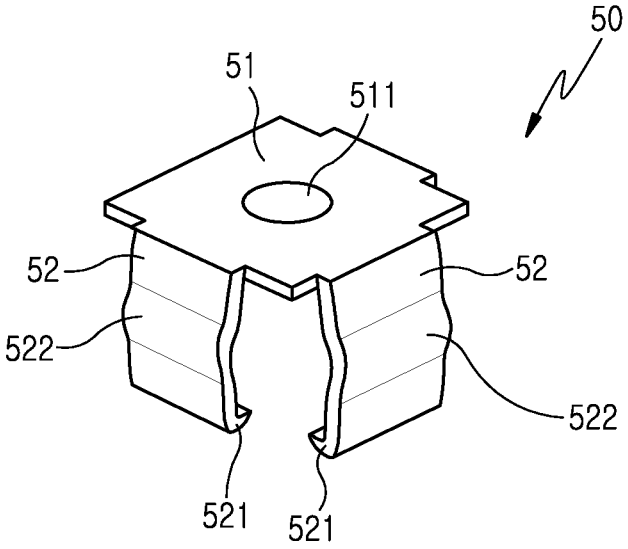
FIG. 5 illustrates an electrical connecting device according to an embodiment of the present invention.

FIG. 5 illustrates an electrical connecting device according to an embodiment of the present invention.

Referring to FIG. 5, the electrical connecting device 50 includes a plate part 51, and at least two legs 52, which extend from the plate part 51 and bend down.

The leg 52 are formed to have curved shape, which comes in tension contact to an inner side wall of the housing recess 32 provided in the substrate mounting part 31 of the bracket 30. Although three legs 52 are formed at regular intervals in FIG. 5, four, five, etc, legs may also be formed.

Although the plate part 51 illustrated in FIG. 5 has a rectangular shape, the plate part 51 may have another shape, such as a polygon, a circle, an oval, etc.

Additionally, the plate part 51 may be formed to have a roughly flat shape in order to get in surface contact with a grounding pad (e.g., the grounding pad 21 of FIG. 4) electrically connecting with a grounding part of the substrate 20.

The legs 52 are formed with the curved outsides and are then again bent inside at the ends, such that the leg 52 may advantageously contact with the inner side wall of the housing recess 32. Similar to the legs 12 of the electrical connecting device 10, ends 521 of the legs 52 are formed to have a hook shape bending inside, such that when the electrical connecting device 50 is mounted on the bracket 30, each of legs 52 of the electrical connecting device 50 may be easily placed into the housing recess 32 of the bracket 30.

The legs 52 also include protrusion parts 522 at their curved portions. Accordingly, when the legs 52 are inserted into the housing recess 32 of the bracket 30, the protrusion parts 522 of the legs 52 contact with the inner side walls of the housing recess 32. When the legs 52 are injected or pressing-processed, the protrusion parts 522 may be also formed together with the legs 52.

Figure 6:
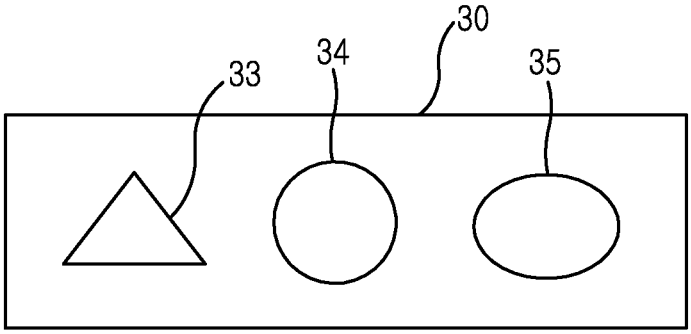
FIG. 6 illustrates a housing recess for housing an electrical connecting device according to an embodiment of the present invention.

FIG. 6 illustrates a housing recess for housing an electrical connecting device according to an embodiment of the present invention.

Referring to FIG. 6, commonly, the housing recess 30 provided in the bracket 30 may have a shape matching with a shape of a plate part of an electrical connecting device. For example, the housing recess 30 provided in the bracket 30 and housing the legs 12 of the electrical connecting device 10 may be a triangular housing recess 33, a circular housing recess 34, and an oval housing recess 35. Of course, the present invention is not limited to these examples, and the housing recess 30 may be provided in various shapes.

Figure 7:
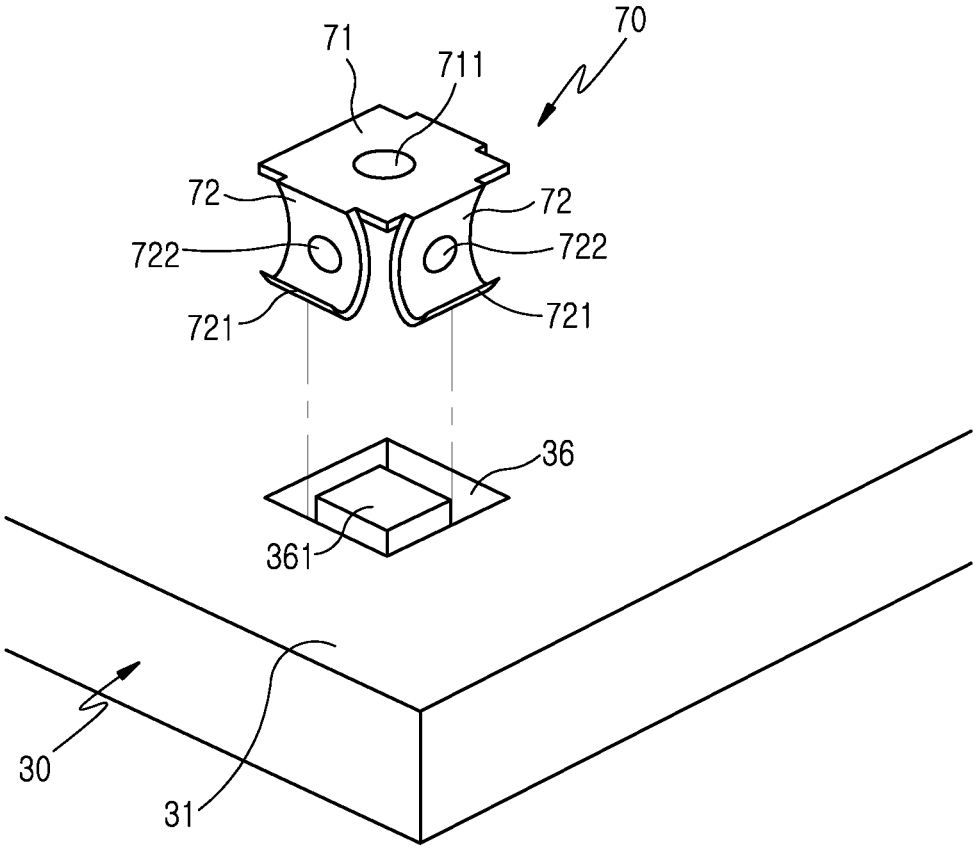
FIG. 7 illustrates an electrical connecting device applied between a substrate and a metal structure according to an embodiment of the present invention.

FIG. 7 illustrates an electrical connecting device applied between a substrate and a metal structure according to an embodiment of the present invention.

Referring to FIG. 7, the electrical connecting device 70 includes a plate part 71 and at least two legs 72, which extend from the plate part 71 and bend down.

The leg 72 have a shape being curved inside, and may be housed in a housing recess 36 provided in the substrate mounting part 31 of the bracket 30. As illustrated in FIG. 7, three legs 72 are formed at regular intervals, but the legs 72 may also include four, five, etc., legs.

Although the plate part 71 illustrated in FIG. 7 has a rectangular shape, it may be formed to have another shape, such as a polygon, a circle, an oval, etc.

The plate part 71 is formed to have a roughly flat shape in order to get in surface contact with a grounding pad (e.g., grounding pad 21 of FIG. 8) electrically connecting with a grounding part of the substrate 20.

A pick-up area 711 is also formed in the plate part 71, which is advantageous to an SMT of a robotic automation process of the electrical connecting device 70.

The legs 72 are formed to have a curved shape being curved inside and then bend again outside at ends 721, such that the legs 72 advantageously contact with outer circumference surfaces of a support protrusion 361 protrusion formed in the housing recess 36. The ends 721 of the legs 72 are formed to have a hook shape being bent outside, such that when the electrical connecting device 70 is mounted in the bracket 30, each of the legs 72 of the electrical connecting device 70 may be advantageously introduced into the housing recess 36 of the bracket 30. The legs 72 also include a tension protrusion 722 that is embossing-processed inside, such that when the leg 72 is inserted into the housing recess 36 of the bracket 30, the tension protrusion 722 of the leg 72 advantageously contacts the outer circumference surface of the support protrusion 361.

Figure 8:
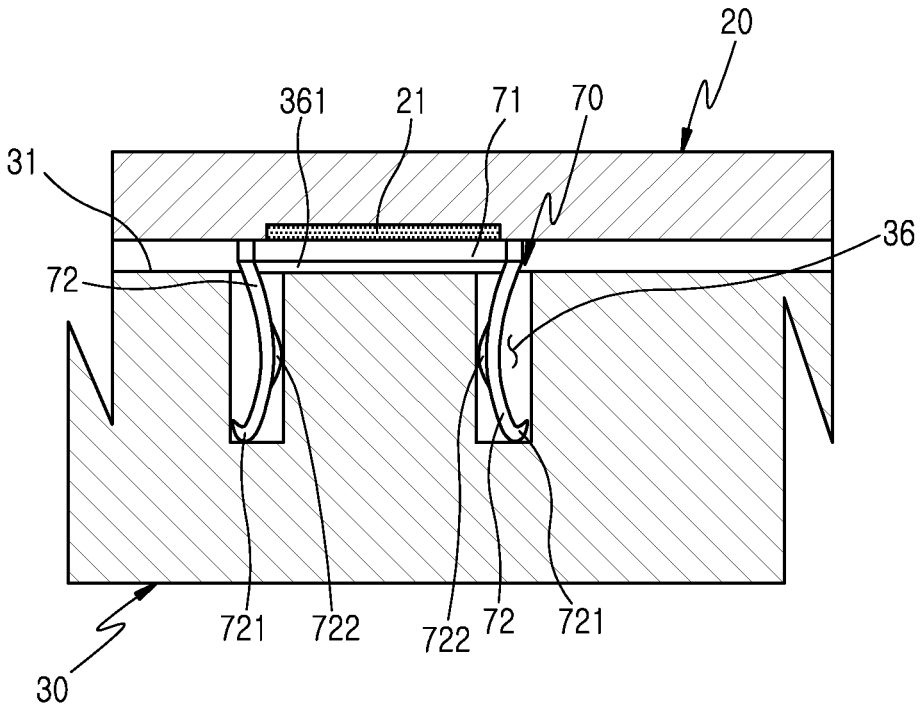
FIG. 8 illustrates an electrical connecting device installed between a substrate and a metal structure according to an embodiment of the present invention.

FIG. 8 illustrates an electrical connecting device installed between a substrate and a metal structure according to an embodiment of the present invention.

Referring to FIG. 8, the electrical connecting device 70 is fixed to the substrate 20. The plate part 71 of the electrical connecting device 70 is exposed to the substrate 20, and is fixed to the grounding pad 21 electrically connected with a grounding region of the substrate 20. The plate part 71 may be fixed in a manner of surface contacting with the grounding pad 21 of the substrate 20. For example, the plate part 71 may be fixed to the grounding pad 21 by bonding, soldering, or using a conductive double-sided tape. Accordingly, each of the legs 72 of the electrical connecting device 70 fixed to the substrate 20 may maintain a state of being protruded toward the bracket 30.

An electrical connection is achieved by inserting each leg 72 into the housing recess 36 of the bracket 30, such that each of the legs 72 contacts with the outer circumference surface of the support protrusion 361 protruded from a bottom surface of the housing recess 36 to at least a top surface of the bracket 30, merely by mounting the substrate 20 to which the electrical connecting device 70 is fixed onto the bracket 30. When the legs 72 are inserted into the housing recess 36, the curve-shaped legs 72 may be warped under elasticity at its inner side, such a force is provided inwards, holding the electrical connecting device 70 in the housing recess 36. As such, the legs 72 are not easily released from the housing recess 36, without a constant force applied.

The tension protrusions 722 of the legs 72 contact with the outer circumference surface of the support protrusion 361. Although not illustrated, the outer circumference surface of the support protrusion 361 may also include tension recesses for receiving the tension protrusions 722 of the legs 72.

As illustrated in FIG. 8, the plurality of legs 72 of the electrical connecting device 70 contact the outer circumference surface of the support protrusion 361 of the housing recess 36 provided in the metal bracket 30 and form a multiple contact points with the outer circumference surface of the support protrusion 361 of the housing recess 36. As a result, the multiple contact points have a greater joint force than that of a single contact.

Figure 9:
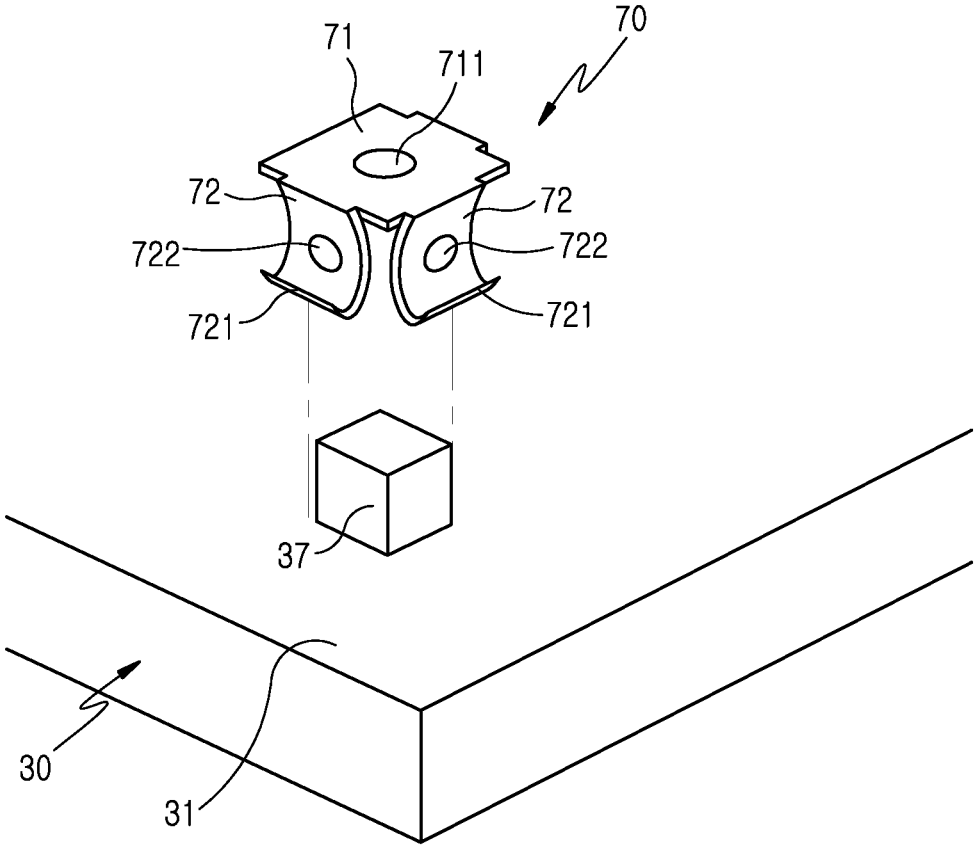
FIG. 9 illustrates an electrical connecting device applied between a substrate and a metal structure according to an embodiment of the present invention.

FIG. 9 illustrates an electrical connecting device applied between a substrate and a metal structure according to an embodiment of the present invention. Notably, the electrical connecting device illustrated in FIG. 9 has the same construction of the electrical connecting device 70, as illustrated in FIGS. 7 and 8. Accordingly, respective constituent elements of the electrical connecting device 70 are denoted by the same numbers.

Referring to FIG. 9, the electrical connecting device 70 includes a plate part 71 and at least two legs 72, which extend from the plate part 71 and bend down.

The legs 72 have a shape being curved inside, and clamp onto an outer circumference surface of a housing protrusion 37 protrusion formed on the substrate mounting part 31 of the bracket 30. The electrical connecting device 70 electrically connects the substrate 20 with the bracket 30 in such a manner that the housing protrusion 37 of the bracket 30 is tightly interposed among the respective legs 72 of the electrical connecting device 70. Although FIG. 9 illustrates, three legs 72 formed at regular intervals, the electrical connecting device 70 may have various numbers of legs.

The plate part 71 has a rectangular shape, but may be formed to have another shape, e.g., a polygon, a circle, an oval, etc.

The plate part 71 is formed to have a roughly flat shape in order to get in surface contact with a grounding pad (e.g., grounding pad 21 of FIG. 10) electrically connecting with a grounding part of the substrate 20.

A pick-up area 711 is also formed in the plate part 71, which is advantageous to an SMT of a robotic automation process of the electrical connecting device 70.

The legs 72 are formed with a curved shape being curved inside and again bent outside at ends 721, such that the housing protrusion 37 may be advantageously housed within the respective legs 72. The ends 721 of the legs 72 have a hook shape being bent outside. Further, the legs 72 have tension protrusions 722 that are embossing-processed inside, such that when the housing protrusion 37 of the bracket 30 is housed among the respective legs 72, the tension protrusion 722 of the leg 72 advantageously contacts the outer surface of the housing protrusion 37.

Figure 10:
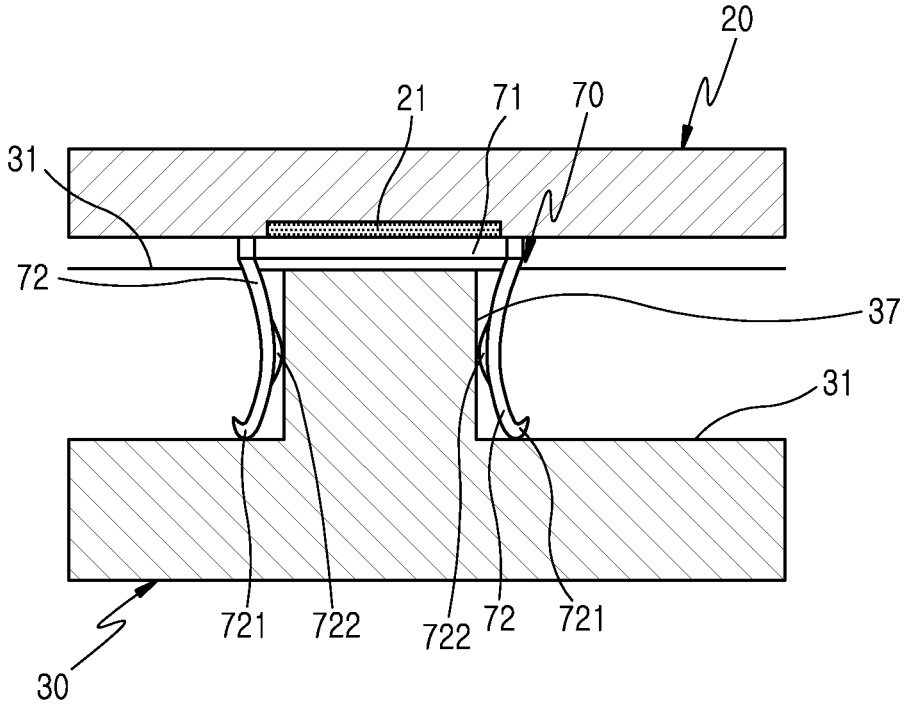
FIG. 10 illustrates an electrical connecting device installed between a substrate and a metal structure according to an embodiment of the present invention.

FIG. 10 illustrates an electrical connecting device installed between a substrate and a metal structure according to an embodiment of the present invention.

Referring to FIG. 10, the electrical connecting device 70 is fixed to the substrate 20. The plate part 71 of the electrical connecting device 70 is exposed to the substrate 20, and is fixed to the grounding pad 21 electrically connected with a grounding region of the substrate 20. The plate part 71 is fixed in a manner of surface contacting with the grounding pad 21 of the substrate 20. For example, the plate part 71 may be fixed to the grounding pad 21 by bonding, soldering, or using a conductive double-sided tape. Accordingly, each of the legs 72 of the electrical connecting device 70 fixed to the substrate 20 may maintain a state of being protruded toward the bracket 30.

The electrical connecting device 70 tightly fits around the housing protrusion 37 of the bracket 30, merely by mounting the substrate 20 to which the electrical connecting device 70 is fixed onto the bracket 30. When the legs 72 surround the housing protrusion 37, the curve-shaped legs 72 provide an elastic force inwards that holds the housing protrusion 37. As such, when the housing protrusion 37 is housed among the legs 72, the legs 72 are not easily released from the housing protrusion 37, without a constant force being applied.

The tension protrusions 722 of the legs 72 contact with the outer circumference surface of the housing protrusion 37.

Although not illustrated, the outer circumference surface of the housing protrusion 37 may also include tension recesses for receiving the tension protrusions 722 of the legs 72.

As illustrated in FIG. 10, a plurality of legs 72 of the electrical connecting device 70 contact the outer surface of the housing protrusion 37 protrusion formed on the metal bracket 30 and form a multiple contact points with the outer surface of the housing protrusion 37 of the metal bracket 30. In this case, the multiple contact points have greater joint force than that of a single contact.

The various electrical connecting devices according to the above-described embodiments of the present invention may secure structural reliability against long-time use and provide improved continuous electrical connection against external impact. Further, electrical connecting devices according to the above-described embodiments of the present invention assemble simply and prevent mutual interference between accessories.

While the present invention has been particularly shown and described with reference to certain embodiments thereof, it will be understood by those of ordinary skill in the art that various changes in form and details may be made therein without departing from the spirit and scope of the present invention as defined by the following claims and their equivalents.

What is claimed is:

1. An electrical connecting device comprising:
a plate part fixed to a first structure; and
at least one leg extending from the plate part,
wherein, when the first structure is mounted on a second structure, the at least one leg is electrically connected to a housing recess provided in the second structure, and
wherein the at least one leg comprises a tension protrusion emboss that contacts an inner side surface of the housing recess.

2. The electrical connecting device of claim 1, further comprising at least two legs extending from the plate part, wherein the at least two legs are arranged substantially perpendicular to the plate part, on a same side of the plate part.

3. The electrical connecting device of claim 2, wherein the housing part comprises a housing protrusion protruding from the second structure, and
wherein the housing protrusion is received between the at least two legs.

4. The electrical connecting device of claim 1, wherein the first structure comprises a substrate,
wherein the second structure comprises a metal structure, and
wherein the electrical connecting device electrically connects a grounding region of the substrate to the metal structure.

5. The electrical connecting device of claim 4, wherein the metal structure comprises a bracket for structural reinforcement of an electronic device.

6. The electrical connecting device of claim 4, wherein the metal structure comprises a shield that is mounted on the substrate for shielding noise of electronic function groups.

7. The electrical connecting device of claim 1, further comprising a plurality of legs extending from the plate part, wherein the leg and the plurality of legs are substantially perpendicular to the plate part, on a same side of the plate part, arranged from each other at regular intervals.

8. The electronic device of claim 1, wherein the plate part is fixed to an exposed contact pad of the first structure.

9. An electrical connecting device comprising:
a plate part fixed to a first structure; and
at least one leg extending from the plate part,
wherein, when the first structure is mounted on a second structure, the at least one leg is electrically connected to a housing recess provided in the second structure,
wherein the at least one leg has a curved shape under the plate part, and
wherein the at least one leg contacts with an inner side surface of the housing recess or an outer surface of a support protrusion protruded and formed upward from a bottom surface of the housing recess.

10. The electrical connecting device of claim 9, wherein the at least one leg further comprises a tension protrusion that contacts the outer surface of the support protrusion.

11. An electronic device comprising:
a substrate;
an electrical connecting device mounted on the substrate; and
a metal bracket electrically connected to the substrate via the electrical connection device,
wherein the electrical connecting device comprises:
a plate part fixed to a first structure; and
at least one leg extending from the plate part,
wherein, when the first structure is mounted on a second structure, the leg is electrically connected to a housing recess provided in the second structure, and
wherein the at least one leg comprises a tension protrusion emboss that contacts an inner side surface of the housing recess.

12. The electronic device of claim 11, wherein the at least one leg has a curved shape, the curved shape curving outside of the plate part.

13. The electronic device of claim 11, wherein the electrical connecting device connects a grounding region of the substrate to the metal bracket and extends the grounding region or shields noise generated in a peripheral electronic function group.

14. An electronic device comprising:
a substrate;
an electrical connecting device mounted on the substrate; and
a metal bracket electrically connected to the substrate via the electrical connection device,
wherein the electrical connecting device comprises:
a plate part fixed to a first structure; and
at least one leg extending from the plate part,
wherein, when the first structure is mounted on a second structure, the leg is electrically connected to a housing recess provided in the second structure, and
wherein the at least one leg comprises a tension protrusion emboss that contacts with an inner side surface of the housing recess or an outer surface of a support protrusion protruded and formed upward from a bottom surface of the housing recess.

* * * * *